US007489591B2

(12) United States Patent
Mumby

(10) Patent No.: US 7,489,591 B2
(45) Date of Patent: Feb. 10, 2009

(54) DRILLING FLUID PRESSURE PULSE DETECTION USING A DIFFERENTIAL TRANSDUCER

(75) Inventor: Edward S. Mumby, Houston, TX (US)

(73) Assignee: PathFinder Energy Services, Inc., Houston, TX (US)

( * ) Notice: Subject to any disclaimer, the term of this patent is extended or adjusted under 35 U.S.C. 154(b) by 93 days.

(21) Appl. No.: 11/417,386

(22) Filed: May 4, 2006

(65) Prior Publication Data

US 2006/0250893 A1 Nov. 9, 2006

Related U.S. Application Data

(60) Provisional application No. 60/678,664, filed on May 6, 2005.

(51) Int. Cl.
*E21B 47/18* (2006.01)

(52) U.S. Cl. ..... 367/83; 367/81; 340/854.3

(58) Field of Classification Search ..... 367/81, 367/83, 82; 340/853.1–853.3, 854.3
See application file for complete search history.

(56) References Cited

U.S. PATENT DOCUMENTS 3,488,629 A * 1/1970 Claycomb ..... 367/83
3,555,504 A * 1/1971 Fields ..... 367/83
3,595,075 A * 7/1971 Dower ..... 73/152.19
4,715,022 A * 12/1987 Yeo ..... 367/83
5,006,845 A * 4/1991 Calcar et al. ..... 367/81
5,361,837 A * 11/1994 Winbow ..... 166/249
5,515,336 A * 5/1996 Chin et al. ..... 367/83
5,535,177 A * 7/1996 Chin et al. ..... 367/81
6,097,310 A * 8/2000 Harrell et al. ..... 340/854.3
6,308,562 B1 10/2001 Abdallah et al.
6,421,298 B1 * 7/2002 Beattie et al. ..... 367/83
6,741,185 B2 * 5/2004 Shi et al. ..... 340/853.2
7,123,161 B2 * 10/2006 Jeffryes et al. ..... 340/854.3

FOREIGN PATENT DOCUMENTS

GB 2333787 A 8/1999

* cited by examiner

*Primary Examiner*—Jack W Keith
*Assistant Examiner*—Scott A Hughes

(57) ABSTRACT

An apparatus for detecting mud pulse telemetry signals includes a differential transducer. In various exemplary embodiments, a high-pressure side of the differential transducer is in fluid communication with either drilling fluid in a standpipe (which is in fluid communication with drilling fluid in the borehole) or a gas chamber of a pulsation dampener. Exemplary embodiments typically further include a pressure delay module in fluid communication with the low-pressure side of the differential transducer and the gas chamber of the pulsation dampener. The invention is intended to advantageously improve the reliability and bandwidth of mud pulse telemetry communications in oilfield drilling applications.

17 Claims, 8 Drawing Sheets

DRILLING FLUID PRESSURE PULSE DETECTION USING A DIFFERENTIAL TRANSDUCER

RELATED APPLICATIONS

This application claims the benefit of U.S. Provisional Application Ser. No. 60/678,664 entitled Drilling Fluid Pressure Pulse Detection Using a Differential Transducer, filed May 6, 2005.

FIELD OF THE INVENTION

The present invention relates generally to mud pulse telemetry techniques for receiving data from a downhole tool. More particularly, this invention relates to an apparatus and method for receiving drilling fluid pressure pulses, the apparatus including a differential transducer.

BACKGROUND OF THE INVENTION

Typical petroleum drilling operations employ a number of techniques to gather information about the borehole and the formation through which it is drilled. Such techniques are commonly referred to in the art as measurement while drilling (MWD) and logging while drilling (LWD). As used in the art, there is not always a clear distinction between the terms LWD and MWD. Generally speaking MWD typically refers to measurements taken for the purpose of drilling the well (e.g., navigation) and often includes information about the size, shape, and direction of the borehole. LWD typically refers to measurement taken for the purpose of analysis of the formation and surrounding borehole conditions and often includes various formation properties, such as acoustic velocity, density, and resistivity. It will be understood that the present invention is relevant to both MWD and LWD operations. As such they will be referred to commonly herein as "MWD/LWD."

Transmission of data from a downhole tool to the surface is a difficulty common to MWD/LWD operations. Mud pulse telemetry is one technique that is commonly utilized for such data transmissions. During a typical drilling operation, drilling fluid (commonly referred to as "mud" in the art) is pumped downward through the drill pipe, MWD/LWD tools, and the bottom hole assembly (BHA) where it emerges at or near the drill bit at the bottom of the borehole. The mud serves several purposes, including cooling and lubricating the drill bit, clearing cuttings away from the drill bit and transporting them to the surface, and stabilizing and sealing the formation (s) through which the borehole traverses. In a typical mud pulse telemetry operation, a transmission device, such as an electromechanical pulser or a mud siren located near the drill bit generates a series of pressure pulses (in which the data is encoded) that is transmitted through the mud column to the surface. At the surface, one or more transducers convert the pressure pulses to electrical signals, which are then transmitted to a signal processor. The signal processor then decodes the signals to provide the transmitted data to the drilling operator.

One common problem with decoding a mud pulse signal is that the signal to noise ratio is often low owing both to low signal amplitude and high noise content. The amplitude of a transmitted pressure pulse tends to attenuate as it travels up the drill pipe. Such attenuation is dependent on many factors including the depth of the borehole, the type of drilling mud, the hydrostatic pressure, the number of joints in the drill string, and the width of the pressure pulse. Moreover, there are a number of potential sources of noise generated during drilling operations including turning of the drill bit and/or drill pipe in the borehole, sliding and/or impact of the drill pipe against the borehole wall, and the mud pump that is used to pump the mud downhole. Another source of noise is created by reflected signals that are generated when the original pressure pulse hits a pulsation dampener (also referred to in the art as a desurger) near the top of the mud column and reflects back downhole.

To obtain reliable MWD/LWD signal decoding, slow data transmission rates (e.g., on the order of about 1 bit per second) are typically used in order to achieve an acceptable signal to noise ratio. When data transmission rates are increased, the signal to noise ratio tends to decrease due to decreased signal amplitude, thereby decreasing the reliability of the transmitted data. In a typical drilling application, the narrowest pulse that can be properly decoded is about 0.4 seconds or greater. Pressure pulses less than about 0.4 seconds tend to be lost in the background noise.

Recently, techniques employing a high-resolution transducer or two longitudinally spaced transducers have been developed to reduce the effects of noise (and therefore to increase the signal to noise ratio). In the dual transducer configuration, the signal at a second transducer is subtracted from the signal at a first transducer. Various electronic filters are also typically used in such applications. One such technique (disclosed in U.S. Pat. No. 6,308,562 to Abdallah et al.) utilizes a first transducer on the standpipe and a second at or near the pulsation dampener. The technique further utilizes an adaptive noise canceller to produce a processed signal with more sharply defined leading and trailing edges. A high-resolution transducer provides some improvement over traditional single transducer systems, but the signal to noise ratio can be unacceptably high even with such improved transducers.

Therefore, there exists a need for an improved drilling fluid pressure pulse detection apparatus and methods for detecting transmitted pressure pulses in the drilling fluid. In particular, there exists a need for a apparatus capable of detecting high speed, low amplitude pressure pulses.

SUMMARY OF THE INVENTION

The present invention addresses one or more of the above-described drawbacks of the prior art. One aspect of this invention includes an apparatus for detecting mud pulse telemetry signals. The apparatus includes a differential transducer having high-pressure and low-pressure sides. In various exemplary embodiments, the high-pressure side of the differential transducer is in fluid communication with either drilling fluid in a standpipe (which is in fluid communication with drilling fluid in the borehole) or a gas chamber of a pulsation dampener. Exemplary embodiments typically further include a pressure delay module in fluid communication with the low-pressure side of the differential transducer and the gas chamber of the pulsation dampener.

Exemplary embodiments of the present invention may advantageously provide several technical advantages. For example, exemplary embodiments of this invention increase the signal to noise ratio of mud pulse telemetry signals, thereby potentially increasing the reliability and accuracy of data transmission. As such, exemplary embodiments of this invention may be particularly advantageous in noisy environments. Moreover, exemplary embodiments of this invention also enable the detection of short duration, closely spaced pressure pulses, thereby potentially improving the bandwidth of data transmission.

In one aspect, the present invention includes an apparatus for detecting mud pulse telemetry signals in drilling fluid. The apparatus includes a differential transducer having first and second sides. The first side is in fluid communication with drilling fluid in a standpipe, which is in fluid communication with drilling fluid in a borehole. The apparatus further includes a pulsation dampener including liquid and gas chambers separated by a flexible diaphragm. The liquid chamber is in fluid communication with drilling fluid in the standpipe, and the gas chamber is in fluid communication with the second side of the differential transducer.

In another aspect, this invention includes an apparatus for detecting mud pulse telemetry signals in drilling fluid. The apparatus includes a pulsation dampener including liquid and gas chambers separated by a flexible diaphragm, the liquid chamber in fluid communication with drilling fluid in a standpipe, which is in fluid communication with drilling fluid in a borehole. The apparatus further includes a differential transducer having first and second sides. The first side is in fluid communication with the gas chamber of the pulsation dampener. The apparatus also includes a delay module deployed between the first and second sides of the differential transducer such that the second side of the differential transducer is in fluid communication with the first side of the differential transducer through the delay module.

In still another aspect, this invention includes a portable apparatus for detecting mud pulse telemetry signals in drilling fluid. The portable apparatus includes a differential transducer including first and second sides. The first side is configured to be coupled in fluid communication with a gas chamber of a pulsation dampener. The second side of the differential transducer is in fluid communication with the first side of the differential transducer through a delay module, the delay module including at least one gas accumulator and a flow restrictor.

In a further aspect, this invention includes a method for detecting mud pulse telemetry signals in drilling fluid, the telemetry signals including at least one pressure pulse transmitted uphole through a column of drilling fluid. The method includes detecting a first waveform at a first side of a differential transducer, the first waveform including a first pressure as a function of time, and delaying an arrival of the pressure pulse to a second side of the differential transducer such that a leading edge of the pressure pulses arrives at the second side of the differential transducer at a later time than at the first side of the differential transducer. The method further includes detecting a second waveform at the second side of the differential transducer, the second waveform including a second pressure as a function of time and processing the first and second waveforms to detect the drilling fluid pressure pulse.

The foregoing has outlined rather broadly the features and technical advantages of the present invention in order that the detailed description of the invention that follows may be better understood. Additional features and advantages of the invention will be described hereinafter, which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

Figure 1:
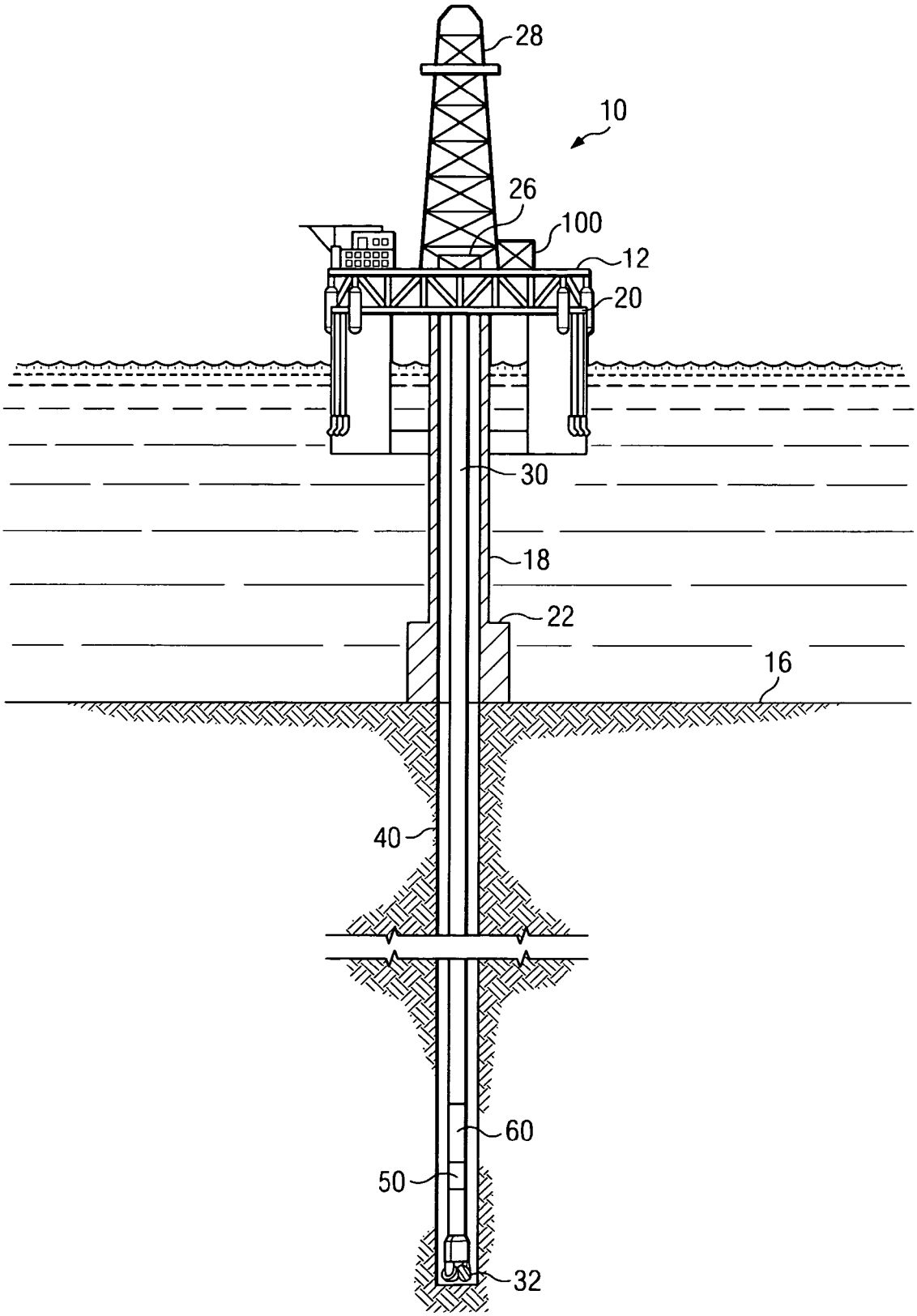
FIG. 1 is a schematic representation of an offshore oil and/or gas drilling platform utilizing an exemplary embodiment of the present invention.

Referring to FIGS. 3A through 8B, it will be understood that features or aspects of the embodiments illustrated may be shown from various views. Where such features or aspects are common to particular views, they are labeled using the same reference numeral. Thus, a feature or aspect labeled with a particular reference numeral on one view in FIGS. 3A through 8B may be described herein with respect to that reference numeral shown on other views.

FIG. 1 schematically illustrates one exemplary embodiment of a pulse detection apparatus (shown schematically at 100) in accordance with this invention in use in an offshore oil and/or gas drilling assembly, generally denoted 10. In FIG. 1, a semisubmersible drilling platform 12 is positioned over an oil or gas formation (not shown) disposed below the sea floor 16. A subsea conduit 18 extends from deck 20 of platform 12 to a wellhead installation 22. The platform may include a derrick 26 and a hoisting apparatus 28 for raising and lowering the drill string 30, which, as shown, extends into borehole 40 and includes drill bit 32, a transmission device 50 (e.g., a conventional electromechanical pulser), and an MWD/LWD tool 60. Drill string 30 may optionally further include substantially any number of other tools including, for example, other MWD/LWD tools, stabilizers, a rotary steerable tool, and a downhole drilling motor.

It will be understood by those of ordinary skill in the art that the deployment illustrated on FIG. 1 is merely exemplary for the purposes of describing the invention set forth herein. It will be further understood that pulse detection apparatuses 100 of the present invention are not limited to use with a semisubmersible platform 12 as illustrated on FIG. 1. The invention is equally well suited for use with any kind of subterranean drilling operation, either offshore or onshore.

Figure 2:
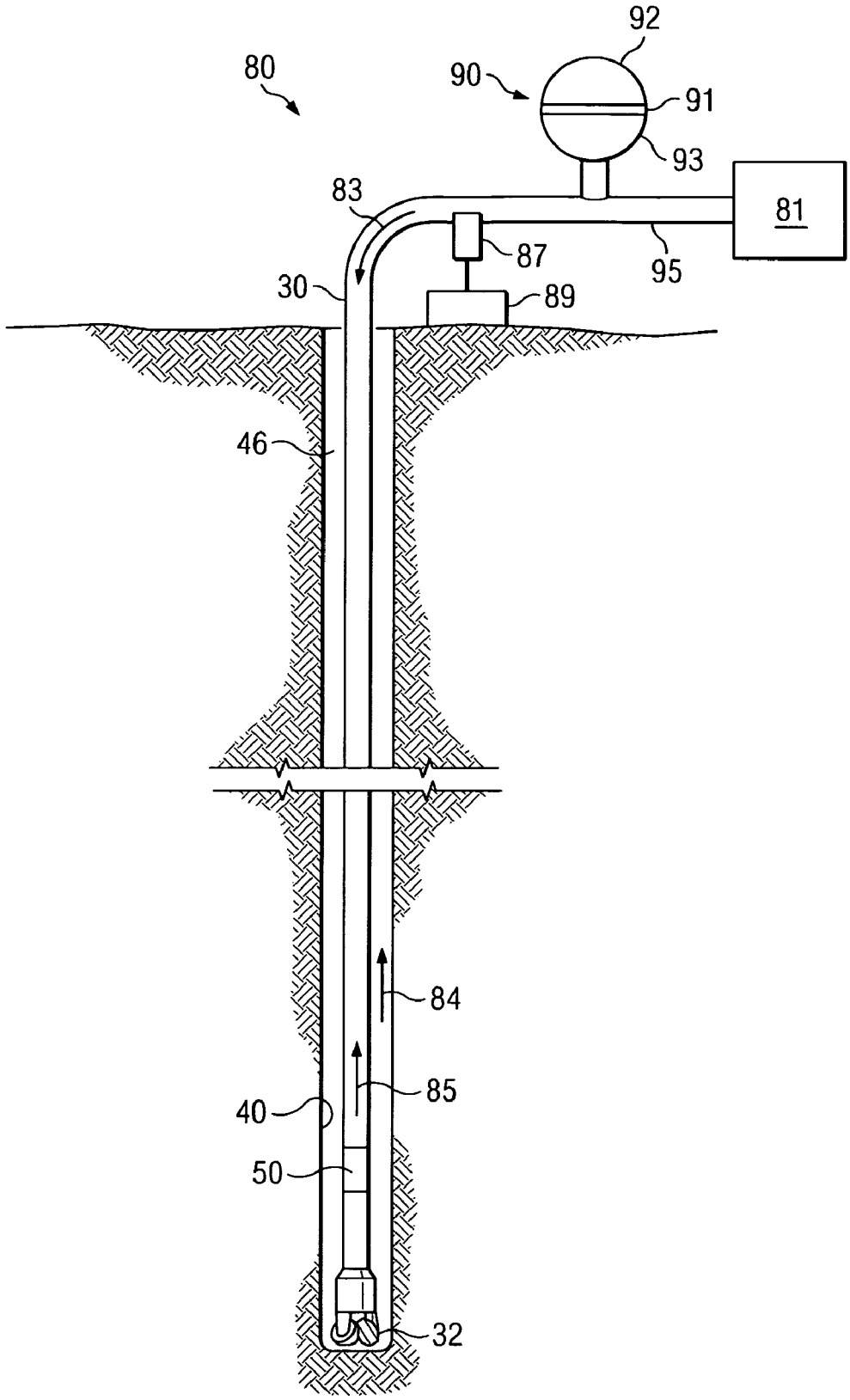
FIG. 2 (PRIOR ART)
FIG. 2 depicts an exemplary mud flow diagram of the prior art including a conventional transducer.

Referring now to FIG. 2, an exemplary prior art mud pulse telemetry apparatus 80 is illustrated. As described briefly in the Background Section, a mud pump 81 generates a downward traveling mud flow 83 into a standpipe 95 and down through drill string 30. Rotation of the drill string (and/or drill bit 32) creates borehole 40 in the earth (or sea floor 16 shown on FIG. 1). The mud flow 83 emerges at or near the drill bit 32 into the borehole 40 and creates an upward traveling mud flow 84 through an annulus 46 (the space between the drill string 30 and the borehole wall). A transmission device 50, such as an electromechanical mud pulser or a mud siren, produces an acoustic pressure wave (the "signal") 85 that travels at approximately the speed of sound (typically in the range of about 2000 to 4000 feet per second) through the downward traveling mud flow 83 and is received (or detected) at a transducer 87. It will be appreciated that the signal may also be transmitted through and received from the upward traveling mud flow 84 in the annulus 46. The transducer 87 is typically connected to a signal processor 89 that decodes and analyzes the signal 85. The transmitted data may be encoded using substantially any suitable scheme, including for example pulse position or phase and amplitude of the signal.

Also included in prior art apparatus 80 is a pulsation dampener (also referred to as a desurger) 90 that evens out the flow 83 of mud in the standpipe 95 and drill string 30. A membrane 91 (also referred to as a diaphragm) separates the pulsation dampener 90 into a drilling fluid chamber 93 and a gas chamber 92. The pulsation dampener 90 essentially acts like an accumulator to smooth outlet pressure generated by the mud pump 81. The use of a single transducer apparatus 80 as shown on FIG. 2 in which the range of the transducer is sufficient to cover the full range of pressure in the standpipe on the rig floor is well known in the art. Such transducers typically have a pressure range on the order of 5000 psi or more.

Figure 3A:
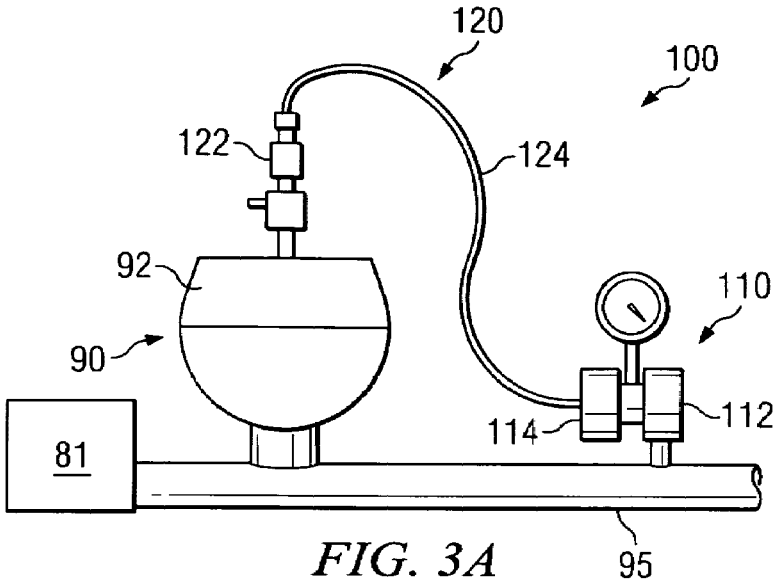
FIG. 3A depicts one exemplary embodiment of a pulse detection apparatus in accordance with the present invention.

Turning now to FIG. 3A, one exemplary embodiment of a pulse detection apparatus in accordance with this invention is illustrated. In the exemplary embodiment shown, apparatus 100 is connected to a conventional drilling fluid pumping arrangement, including a mud pump 81 configured to pump high-pressure drilling fluid into standpipe 95. Standpipe 95 is typically in fluid communication with the drill string (e.g., drill string 30 shown on FIG. 1) such that the mud pump 81 pumps drilling fluid downhole (as shown in the prior art arrangement on FIG. 2). Numerous mud pump 81 and standpipe 95 arrangements are well known in the art. The invention is not limited in this regard. In the exemplary embodiment shown, apparatus 100 includes a differential transducer 110 deployed on the standpipe 95, typically in close proximity to the mud pump 81, with the high-pressure end 112 of the differential transducer 110 connected to the standpipe 95 (which is in fluid communication with the drilling fluid in standpipe 95). The low-pressure end 114 of the differential transducer 110 is coupled to the pressurized gas (nitrogen) chamber 92 of pulsation dampener 90 via a pressure delay module 120 (i.e., in fluid communication with the gas in chamber 92). In the exemplary embodiment shown, delay module 120 includes a snubber 122 connected to gas chamber 92 such that the flow of gas (nitrogen) from the pulsation dampener 90 to the differential transducer 110 is restricted. Delay module 120 further includes a gas accumulator 124 (which in the exemplary embodiment shown includes a length of rubber tubing) connected to the low-pressure end 114 of the differential transducer 110.

Substantially any suitable differential transducer 110 may be utilized, however, a differential transducer having a relatively low-pressure range (as compared to the drilling fluid pressure) tends to advantageously increase the signal amplitude (and therefore the signal to noise ratio). For example, in one exemplary embodiment a Rosemount differential transducer having a differential pressure range from 0 to 1000 psi may be utilized (although the invention is not limited in this regard). Advantageous embodiments of the invention may utilize differential transducers having even lower pressure ranges (e.g., having a pressure range from 0 to 250 psi). Due to the relatively small scale of the differential transducer (as compared to the drilling fluid pressure), the electrical response signal may be significantly larger than that provided by a conventional high-resolution transducer configured to measure the absolute pressure in the standpipe 95.

Pressure delay module 120 may include substantially any arrangement for delaying, restricting, and/or dampening the received pressure pulse from traveling from the pulsation dampener 90 to the low-pressure end 114 of the differential transducer 110. As stated above, the exemplary embodiment shown includes a snubber 122 in series with a gas accumulator 124. As described in more detail below, the effect of the snubber 122 and gas accumulator 124 is to retard the pressure build up on the lower pressure side of the differential transducer 110. The snubber 122 also allows the gas pressure to dissipate quickly from the gas accumulator 124 back into the pulsation dampener 90 leading to a sharp trailing edge on the back end of a detected differential pressure pulse (as described in more detail below). In the exemplary embodiment shown, the snubber 122 may be thought of as a device that behaves like a check valve 122A and a restrictor 122B piped in parallel (as shown schematically in FIG. 4). Suitable snubbers include, for example, a ¼ NPT Model 5025 available from NoShock.

Figure 5:
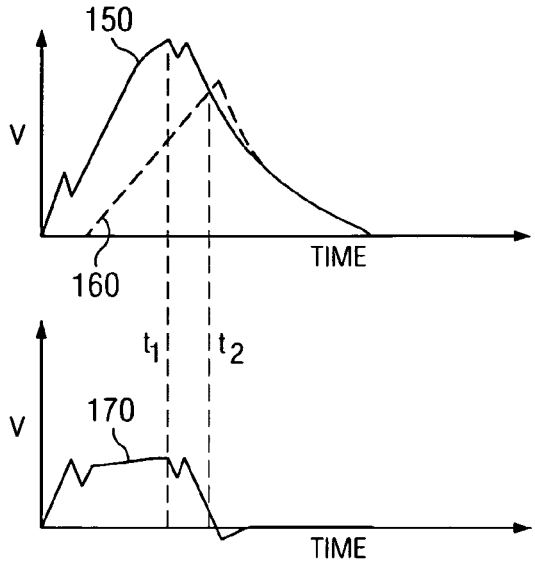
FIG. 5 schematically depicts exemplary pressure waveforms at the high and low-pressure sides of a differential transducer and a resultant differential waveform.

Referring now to FIGS. 3A and 5, function of the exemplary embodiment shown on FIG. 3A is described in more detail. FIG. 5 depicts exemplary waveforms 150 and 160 at the high 112 and low 114 pressure sides of the differential transducer 110 and a resultant differential waveform 170. At the high-pressure side 112 of the differential transducer 110, the pressure waveform 150 is essentially that of the transmitted pulse, for example, increasing at time, $t_1$, before approximately leveling off and decreasing at $t_2$ back towards the base pressure. At the low-pressure side 114, however, the pressure waveform 160 increases more slowly due to the restricted flow of nitrogen through the snubber 122. As such, an exemplary differential waveform 170 tends to increase quickly as shown. As pressure waveform 150 decreases it intercepts waveform 160. The pressure in the gas accumulator 124 (at the low-pressure side 114 of transducer 110) quickly equilibrates with the pulsation dampener 90 (the high-pressure side 112 of the transducer 110) since the snubber 122 does not restrict flow from the transducer 110 back into the pulsation dampener 90. As such, the differential waveform 170 decreases sharply back towards the base pressure (rather than gradually as shown in waveform 150).

With continued reference to FIG. 5, it will be appreciated that the trailing end of waveform 170 is sharper than the tail of a waveform measured using a conventional transducer. Such sharp trailing ends are readily discernable in the test data shown (and described in more detail below) on FIGS. 6A and 6B for transmitted pressure pulses having 0.6 and 0.4 second pulse widths. Such sharp trailing ends advantageously improve detection of narrow and closely spaced pressure pulses as compared to the prior art, for example, as shown in the test data on FIGS. 6C and 6D.

With reference now to FIGS. 6A through 6D, waveforms detected with one exemplary embodiment of this invention are contrasted with waveforms detected using conventional high-resolution transducers. This example is provided to illustrate, for example, exemplary advantages of the present invention in detecting drilling fluid pressure pulses as compared to the prior art. The waveforms were generated and detected in a flow loop (test loop) at Pathfinder Energy Services (Houston, Tex.). An electromechanical pulser was configured to produce low amplitude pressure pulses in the test fluid. The signals from three transducers were captured on a digital oscilloscope. The signals are shown on the same scale on each of FIGS. 6A through 6D to highlight the enhanced signal detection capabilities of this invention. Two conventional transducers were utilized. A GP-50 (10,000 psi range) transducer was located near the pulser sub, while a Dynesco (6000 psi range) transducer was located on a standpipe near the pump about 150 feet upstream of the GP-50. A Rosemount (1000 psi range) differential transducer was also located on the standpipe and was configured as shown in FIG. 3A. In this example, the gas accumulator 124 (shown on FIG. 3B) included a twelve-foot length of ⅜ inch ID hose.

Figure 6A:
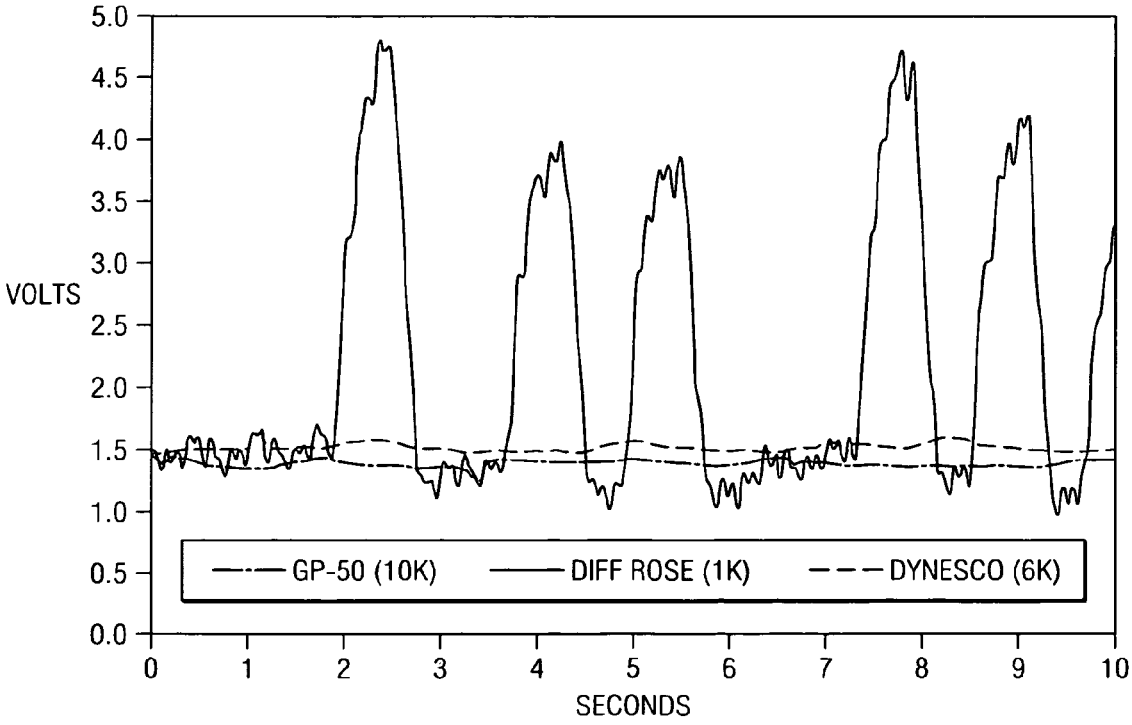
FIGS. 6A through 6D contrast various waveforms detected using one exemplary embodiment the apparatus shown on FIG. 3A with waveforms detected utilizing conventional transducers.
Figure 6B:
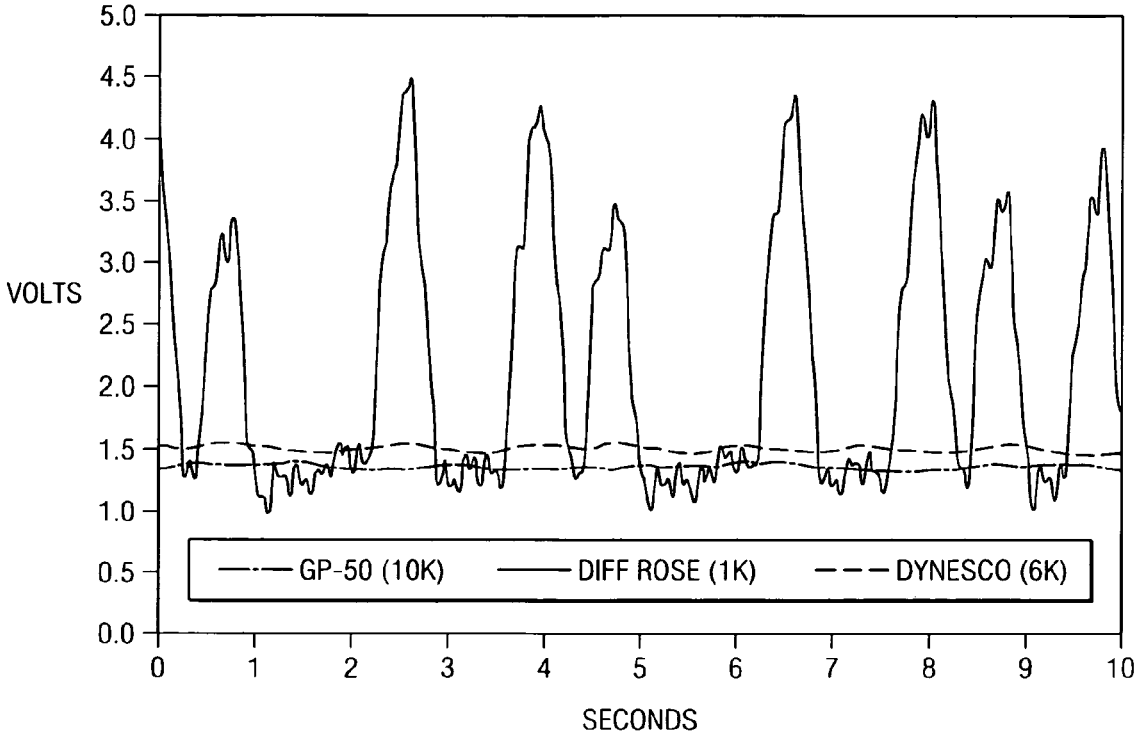
Figure 6C:
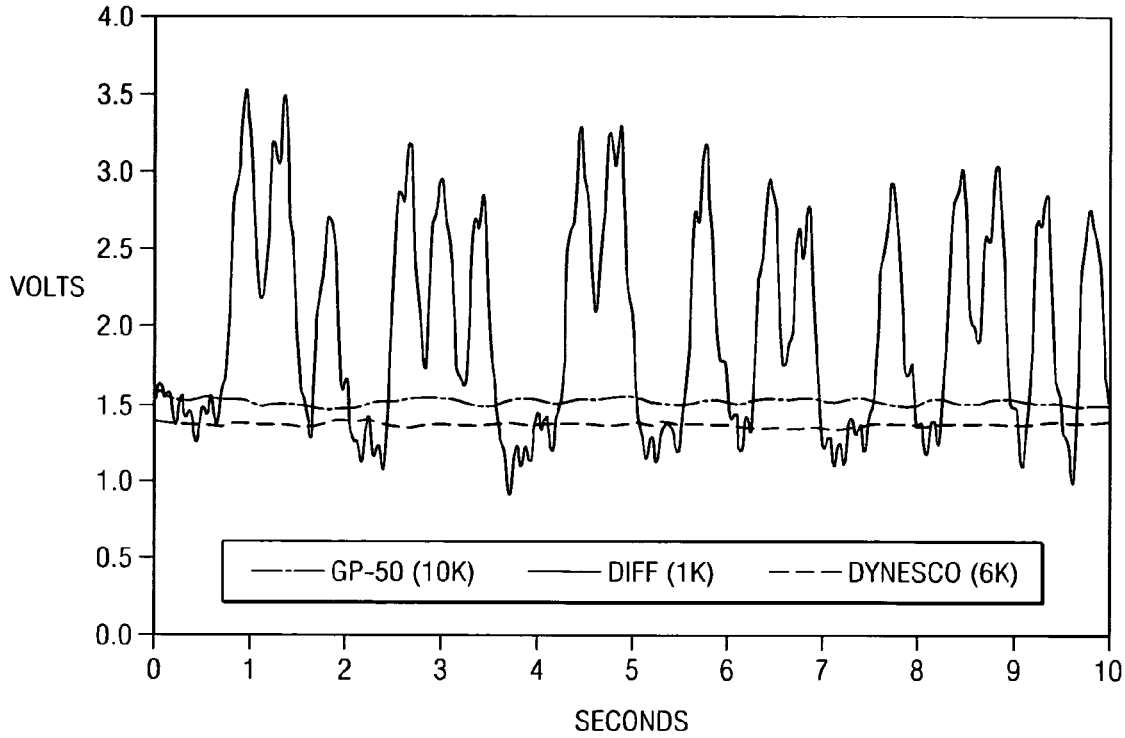
Figure 6D:
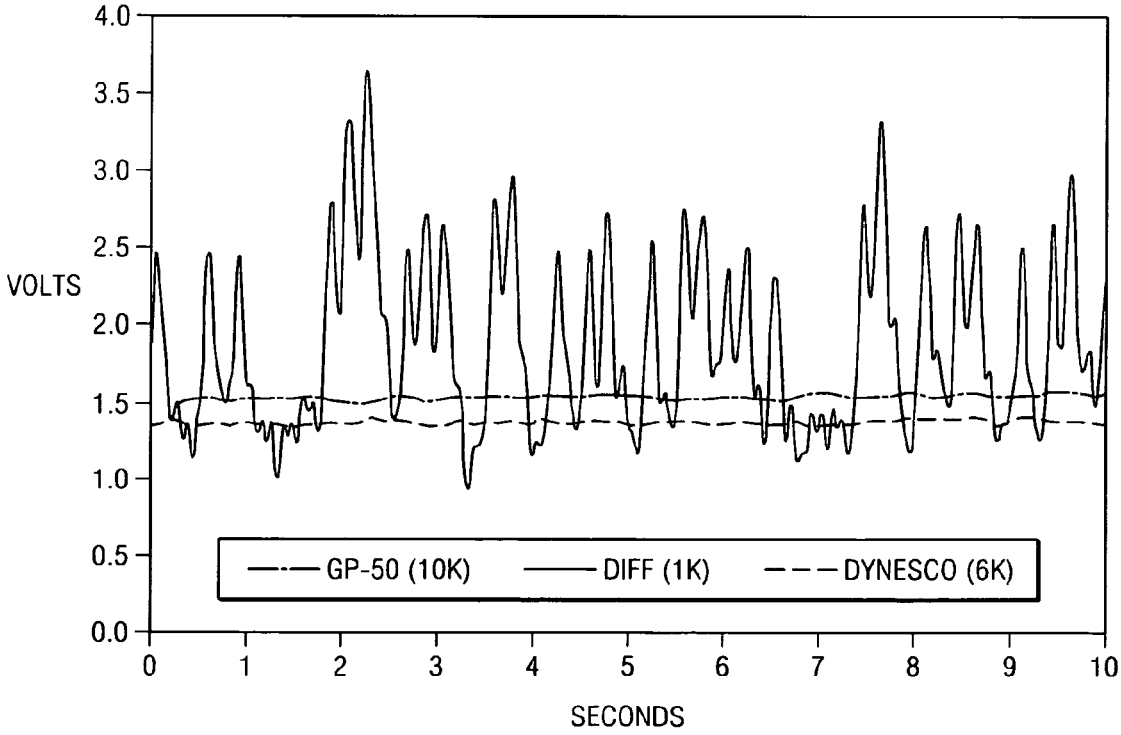

As shown in FIGS. 6A to 6D, the signal to noise ratio of the waveforms detected using embodiments of this invention is superior to that using conventional high resolution transducers. Such improved signal to noise is expected to improve the reliability of pulse detection in mud pulse telemetry operations. Moreover, as shown in FIGS. 6C and 6D, individual pulses are readily distinguishable even for transmitted pressure pulses having 0.2 and 0.1 second pulse widths, despite the use of a differential transducer having only a 0.2 second response time. Further, improved signal to noise and pulse differentiation is expected with a differential transducer having a faster response time.

Figure 3B:
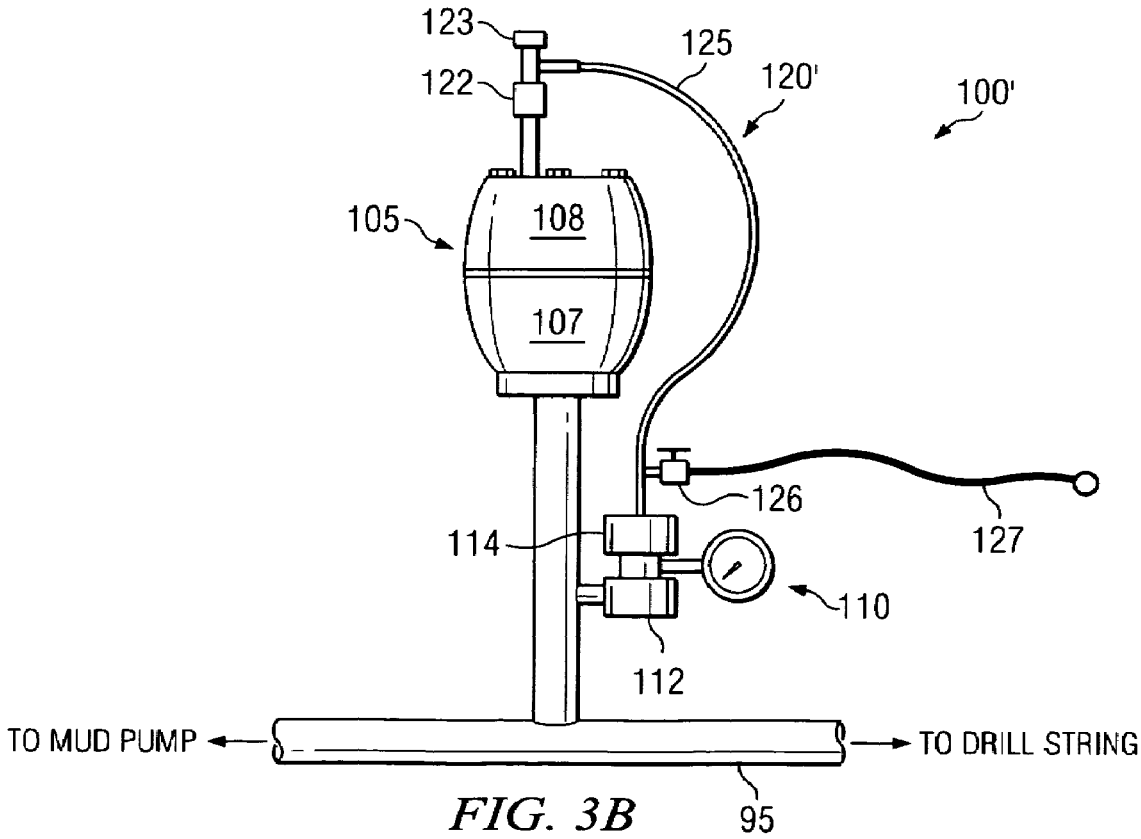
FIG. 3B depicts another exemplary embodiment of a pulse detection apparatus in accordance with the present invention.
Figure 4:
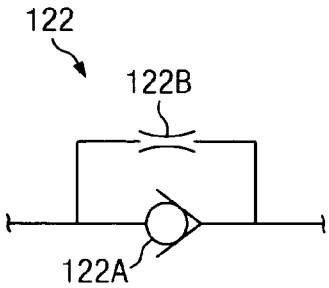
FIG. 4 depicts a schematic diagram of an exemplary snubber 122 shown on FIGS. 3A and 3B.

With reference now to FIG. 3B, an alternative embodiment of a pulse detection apparatus 100' in accordance with the present invention is shown. Apparatus 100' includes a portable pulsation dampener 105, a differential transducer 110, and a delay module 120'. The differential transducer is substantially identical to that described with respect to FIG. 3A, having a high-pressure side 112 in fluid communication with high-pressure drilling fluid (in standpipe 95 and drilling fluid chamber 107 of portable pulsation dampener 105) and a low-pressure side in fluid communication with a gas chamber 108 in portable pulsation dampener 105. Of course, it will be understood that in an equivalent arrangement the high-pressure side of the transducer may be deployed in fluid communication with the gas chamber 108 and the low-pressure side in fluid communication with the drilling fluid. In the exemplary embodiment shown on FIG. 3B, apparatus 100' is connected to the standpipe 95 via a 'T' including a conventional hammer union (although the invention is not limited in this regard). The use of portable pulsation dampener 105 is intended to increase the flexibility and ease of use of apparatus 100'. Such an arrangement enables apparatus 100' to be deployed independently of the desurger in use at the rig (i.e., without making connection to the existing desurger). In some rigs (in particular older rigs), the existing desurger may not include suitable couplings for connecting to the gas chamber 108 or to the standpipe next to the desurger. Portable pulsation dampener 105 is typically small compared to the desurger in use at the rig (e.g., having a drilling fluid volume of less than about 2 gallons). Apparatus 100' is therefore typically easily installed at the rig, e.g., using the rig's existing cat line or air hoist.

With continued reference to FIG. 3B, low-pressure side 114 of differential transducer 110 is connected to (in fluid communication with) the gas chamber 108 of portable pulsation dampener 105. A delay module 120' is deployed between the differential transducer 110 and the portable pulsation dampener 105. As described above with respect to FIG. 3A, a suitable delay module 120, 120' may include substantially any arrangement for delaying a pressure pulse from arriving at the low-pressure side 114 of the differential transducer 110. In the exemplary embodiment shown on FIG. 3B, delay module 120' includes a snubber 122 and first 125 and second 127 accumulators. First accumulator 125 is a relatively low volume accumulator (as compared to the second accumulator 127), for example, including a stiff hose or pipe that provides a conduit for fluid communication between gas chamber 108 and differential transducer 110. In one exemplary embodiment, first accumulator 125 includes a ten-foot length of high-pressure tubing having a quarter inch inner diameter and a pressure rating of 5800 psi. The invention is, of course, not limited in this regard.

Second accumulator 127 is connected to the first accumulator 125 via valve 126. In applications in which additional accumulation capacity is advantageous (as described in more detail below), valve 126 is opened. In the exemplary embodiment shown, second accumulator 127 includes a rubber hose (e.g., a twelve foot length having a three-eighth inch inner diameter and a pressure rating of 4000 psi). It will be appreciated that second accumulator 127 is not limited to the exemplary embodiment shown on FIG. 3B. Accumulator 127 may alternatively include a diaphragm or a pressure chamber such as a mini-desurger (e.g., having a one quart capacity). Second accumulator 127 may also include a variable capacity. For example only, a slidable clamp may be deployed about a length of hose, enabling the length (and therefore the volume) of the accumulator 127 to be manually adjusted.

In the exemplary embodiments shown on FIG. 3B, snubber 122 is substantially identical to that described above with respect to FIGS. 3A and 4. A valve 123 is deployed in conjunction with the snubber 122 enabling it to be actuated and deactuated. For example valve 123 may include a modified relief valve in which the valve seat has been replaced with a rod such that actuation of the valve 123 deactuates the snubber 122. Alternatively, valve 123 may be deployed in parallel with the snubber 122. When the valve 123 is open, the snubber 122 is bypassed. As such, the snubber may be selectively actuated and deactuated as desired (or alternative selectively bypassed). The effect of the snubber on pulse amplitude is described in more below with respect to FIG. 7A.

Figure 7A:
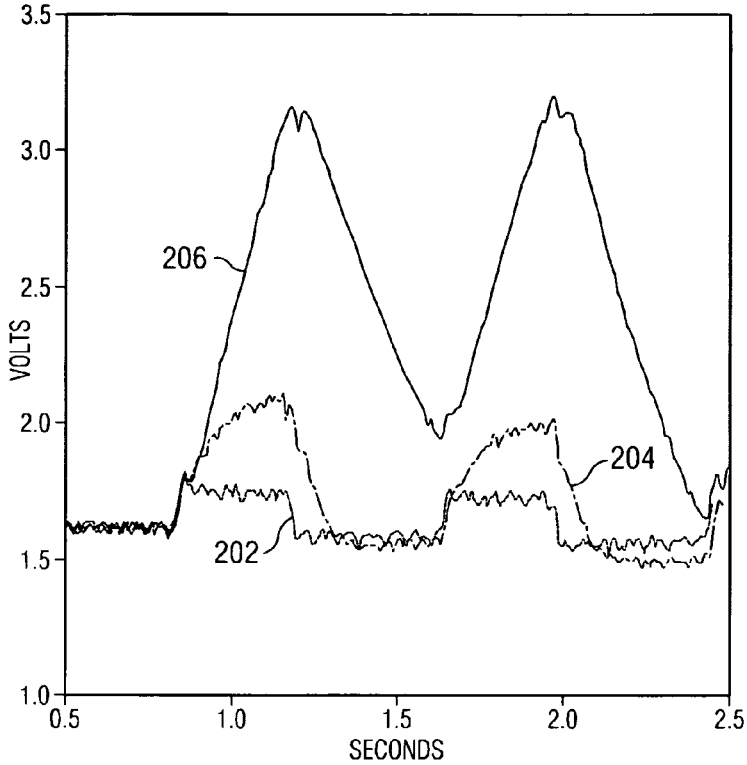
FIGS. 7A and 7B depict waveforms detected using exemplary embodiments of the apparatus shown on FIG. 3B.
Figure 7B:
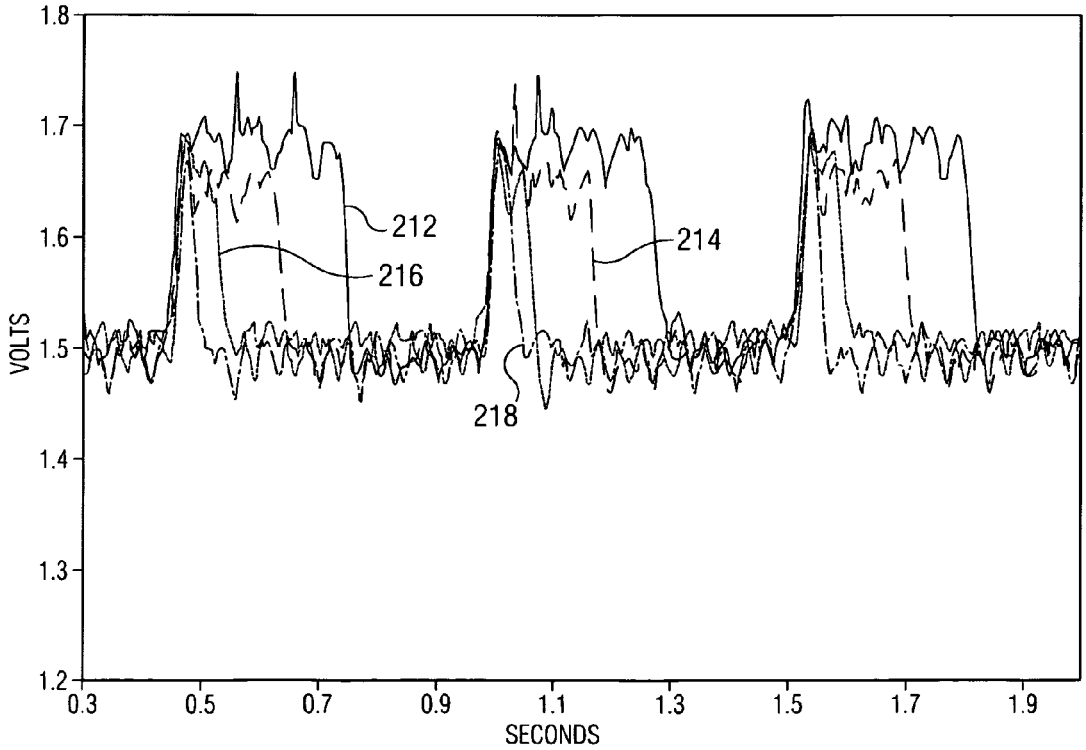

Referring now to FIGS. 7A and 7B, waveforms detected using an exemplary embodiment of pulse detection apparatus 100' (FIG. 3B) are shown. These examples are provided to illustrate, for example, the versatility of apparatus 100'. As with the previous example (FIGS. 6A through 6D), the waveforms were generated and detected in a flow loop (test loop) at Pathfinder Energy Services (Houston, Tex.). An electromechanical pulser was configured to produce low amplitude pressure pulses in the test fluid. The signal from a Rosemount (1000 psi range) differential transducer was captured on a digital oscilloscope. FIG. 7A compares and contrasts the results of various optional configurations on received waveforms 202, 204, and 206 for pressure pulses having a 0.4 second width. Waveform 202 was generated using only the first accumulator 125 (snubber 122 was deactuated as described above and valve 126 was closed). Waveform 202 is similar to a square wave, having sharp leading and trailing edges. The square wave shape (flat top) is the result of a temporal offset between the high and low-pressure sides of the differential transducer (due to the air capacity of the first accumulator 125). Increasing the length of the stiff tubing would be expected to increase the delay time and therefore increase the height of the square wave. Waveform 204 was generated using both the first and second accumulators 125 and 127 (valve 126 open). The snubber 122 was again deactuated. Waveform 204 also has a sharp leading edge, which is followed by a region of decreasing slope to the peak amplitude (due to the increased volume and the elasticity of the second accumulator 127). Waveform 204 has an increased signal to noise ratio (as compared to waveform 202), but a slower trailing edge. Waveform 206 was generated using both the first and second accumulators 125 and 127 and the snubber 122. Waveform 206 has the greatest signal to noise ratio (at the expense of temporal resolution) and is therefore better suited to noisy applications.

With reference now to FIG. 7B, waveforms 212, 214, 216, and 218 are similar to waveform 202 (FIG. 7A) in that they were generated using only the first accumulator 125 (FIG. 3B). The use of the stiff hose as a first accumulator 125 allows a significant shortening of the pulse width without any loss in signal amplitude or degradation of signal to noise ratio (over a range of pulse widths from 0.4 to 0.06seconds). In this example, even at a pulse width of 60 milliseconds (waveform 218), the signal to noise ratio remains above 4:1. The ability to detect such narrow and closely spaced pressure pulses is expected to advantageously improve the bandwidth of data transmission using mud pulse telemetry.

Figure 8A:
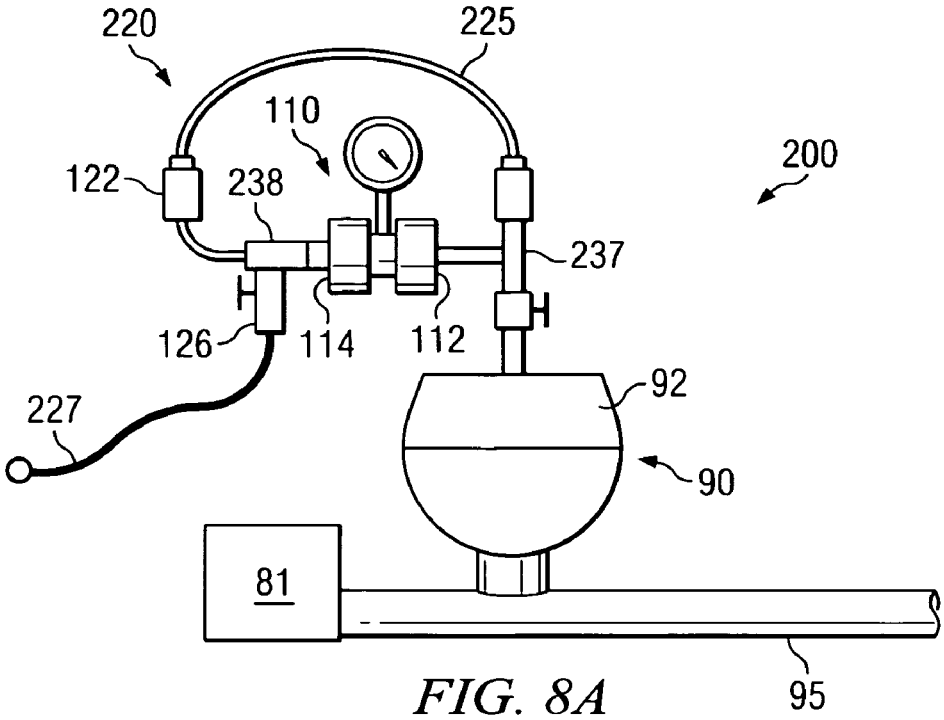
FIGS. 8A and 8B depict further exemplary embodiments of a pulse detection apparatus in accordance with the present invention.
Figure 8B:
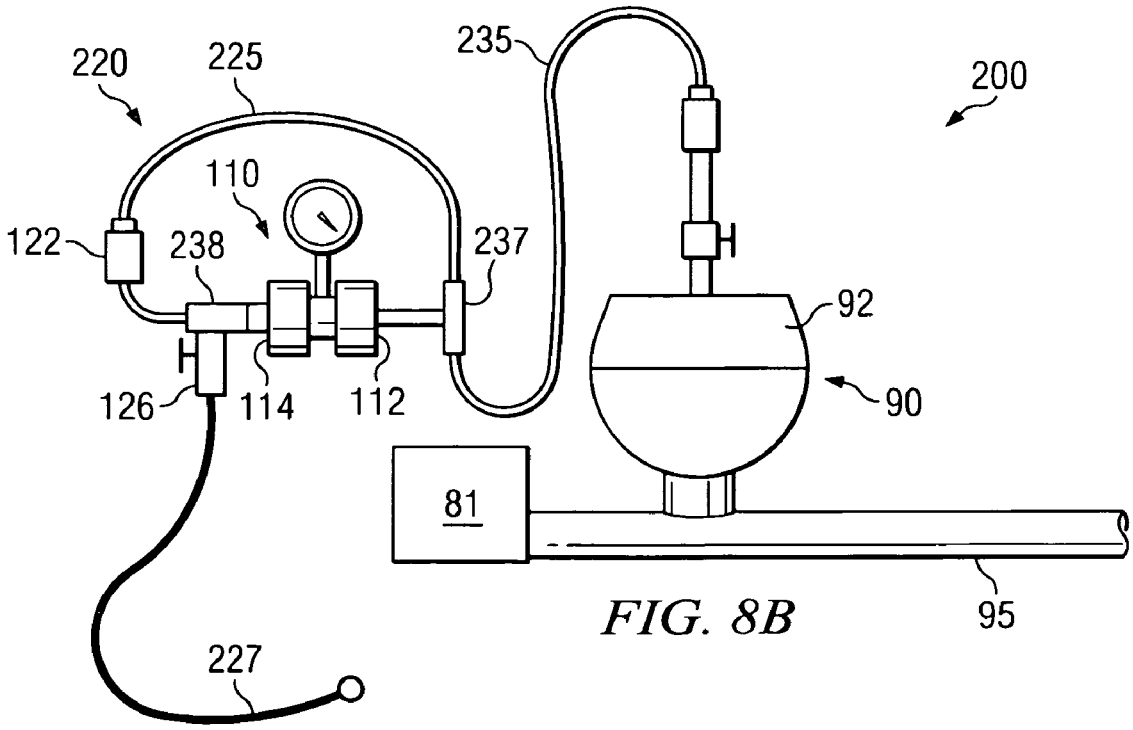

With reference now to FIGS. 8A and 8B, another exemplary embodiment of a pulse detection apparatus 200 in accordance with the present invention is shown. Apparatus 200 includes a differential transducer 110 having a delay module 220 connected thereto. The differential transducer 110 is substantially identical to that described with respect to FIGS. 3A and 3B, having high 112 and low 114 pressure sides (also referred to as first and second sides). The arrangements shown on FIGS. 8A and 8B differ from those shown on FIGS. 3A and 3B in that apparatus 200 is not in direct fluid communication with drilling fluid in the standpipe 95 or mud pump 81. In the exemplary embodiments shown on FIGS. 8A and 8B, both the high and low pressure sides 112, 114 of the differential transducer 110 are in fluid communication with the gas chamber 92 of pulsation dampener 90. In FIG. 8A, apparatus 200 is mounted directly atop the pulsation dampener 90, while in FIG. 8B apparatus 200 is in fluid communication with gas chamber 92 via a length of tubing 235. In the embodiment shown on FIG. 8B apparatus 200 may be advantageously contained, for example, in a portable housing including fittings for connecting to the length of tubing 235. In all other respects the arrangements shown on FIGS. 8A and 8B are substantially identical and are thus described below as a single embodiment.

With continued reference to FIGS. 8A and 8B, the first side 112 of the differential transducer 110 is in fluid communication with the gas chamber 92 of pulsation dampener 90 via a conventional 'T' coupling 237 (although the invention is not limited in this regard). Delay module 220 is deployed between the first 112 and second 114 sides of the differential transducer 110 (between coupling 237 and the second side 114). As described above with respect to FIGS. 3A and 3B, a suitable delay module 220 may include substantially any arrangement for delaying a pressure pulse from arriving at the low-pressure side 114 of the differential transducer 110. In the exemplary embodiments shown on FIGS. 8A and 8B, delay module 220 includes a snubber 122 and first 225 and second 227 accumulators. In the exemplary embodiments shown, first accumulator 225 is a relatively low volume accumulator (as compared to the second accumulator 227), for example, including a stiff hose or pipe that provides a conduit for fluid communication between coupling 237 and snubber 122. First accumulator 225 typically includes a length of high-pressure tubing (e.g., metal or reinforced rubber tubing). The invention is, of course, not limited in these regards.

Second accumulator 227 is deployed downstream of snubber 122, between the snubber 122 and the second side 114 of differential transducer 110 via a second 'T' coupling 238 and valve 126. As described above, in applications in which additional accumulation capacity is advantageous, valve 126 may be opened. In the exemplary embodiment shown, second accumulator 227 includes a rubber hose (e.g., a five foot length having a one-quarter inch inner diameter and a pressure rating of 5000 psi). It will be appreciated that, as described above with respect to FIG. 3B, second accumulator 227 is not limited to the exemplary embodiment shown on FIGS. 8A and 8B. Accumulator 227 may alternatively include a diaphragm or a pressure chamber such as a mini-desurger (e.g., having a one quart capacity). As also described above, accumulator 227 may also have a variable capacity, for example including a moveable clamp deployed about a length of hose.

In the exemplary embodiments shown on FIGS. 8A and 8B, snubber 122 is substantially identical to that described above with respect to FIGS. 3A, 3B, and 4. In the embodiments shown, snubber 122 is advantageously deployed "upside down" such that gravitational force urges the restrictive cylinder downwards into contact with the corresponding seat. Such an orientation advantageously results in more consistent snubbing (restriction) and therefore more consistent pulse amplitudes.

It will be appreciated that apparatus 200 may be advantageous for certain applications in that it does not require fluid communication with drilling fluid in standpipe 95 or elsewhere on the rig floor. Instead, as shown on FIGS. 8A and 8B, a single connection is made to the gas chamber 92 of pulsation dampener 90. As such, apparatus 200 may be advantageously configured as a portable (even a handheld) arrangement, for example, including differential transducer 110 and delay module 220 deployed in a housing (not shown). Such an arrangement may also include a connector mounted to the housing for direct coupling with gas chamber 92. It will also be appreciated that apparatus 200 results in pressure pulses similar to those of apparatus 100' shown on FIGS. 7A and 7B.

Although the present invention and its advantages have been described in detail, it should be understood that various changes, substitutions and alternations can be made herein without departing from the spirit and scope of the invention as defined by the appended claims.

I claim:

1. An apparatus for detecting mud pulse telemetry signals in drilling fluid, the apparatus comprising:

a differential transducer having first and second sides, the first side in fluid communication with drilling fluid in a standpipe, the drilling fluid in the standpipe in fluid communication with drilling fluid in a borehole;

a pulsation dampener including liquid and gas chambers separated by a flexible diaphragm, the liquid chamber in fluid communication with drilling fluid in the standpipe, the gas chamber in fluid communication with the second side of the differential transducer;

a first gas accumulator deployed between the gas chamber and the second side of the differential transducer; and a second gas accumulator in fluid communication with the first gas accumulator, the second gas accumulator including a valve disposed to selectively open and close the second gas accumulator to the first gas accumulator.

2. The apparatus of claim 1, wherein the liquid chamber of the pulsation dampener has a volume of less than about two gallons.

3. The apparatus of claim 1, wherein the differential transducer has a differential pressure range of less than about 1000 psi.

4. The apparatus of claim 1, wherein the first gas accumulator comprises a length of tubing.

5. The apparatus of claim 1, wherein the second gas accumulator comprises a length of flexible tubing.

6. The apparatus of claim 1, further comprising a flow restrictor deployed between the gas chamber and the first accumulator.

7. The apparatus of claim 6, wherein the flow restrictor is disposed to be selectively actuated and deactuated.

8. The apparatus of claim 6, wherein the flow restrictor restricts flow only in a direction from the gas chamber to the low-pressure side of the differential transducer.

9. The apparatus of claim 1, wherein the first gas accumulator comprises a stiff tube and the second gas accumulator comprises a flexible tube.

10. The apparatus of claim 1, wherein the second gas accumulator is configured such that opening the valve increases a signal to noise ratio of a detected signal at the differential transducer.

11. The apparatus of claim 1, wherein the second gas accumulator is configured to have a manually adjustable capacity.

12. An apparatus for detecting mud pulse telemetry signals in drilling fluid, the apparatus comprising:

a pulsation dampener including liquid and gas chambers separated by a flexible diaphragm, the liquid chamber in fluid communication with drilling fluid in a standpipe, the drilling fluid in the standpipe in fluid communication with drilling fluid in a borehole;

a differential transducer having first and second sides, the first side in fluid communication with the gas chamber of the pulsation dampener;

a first gas accumulator deployed between the first and second sides of the differential transducer such that the second side of the differential transducer is in fluid communication with the first side of the differential transducer through the first gas accumulator; and a second gas accumulator in fluid communication with the first gas accumulator, the second gas accumulator including a valve disposed to selectively open and close the second gas accumulator to the first gas accumulator.

13. The apparatus of claim 12, further comprising a flow restrictor deployed between the first and second sides of the differential transducer, the flow restrictor disposed to restrict flow only in a direction from the first side of the differential transducer to the second side of the differential transducer.

14. The apparatus of claim 12, wherein the first gas accumulator comprises a stiff tube and the second gas accumulator comprises a flexible tube.

15. The apparatus of claim 12, wherein the differential transducer has a differential pressure range of less than about 1000 psi.

16. The apparatus of claim 12, wherein the second gas accumulator is configured such that opening the valve increases a signal to noise ratio of a detected signal at the differential transducer.

17. The apparatus of claim 12, wherein the second gas accumulator is configured to have a manually adjustable capacity.

* * * * *